United States Patent [19]

Chatterton

[11] Patent Number: 5,012,655

[45] Date of Patent: May 7, 1991

[54] FILLING ASSEMBLY FOR ICE TRAYS

[76] Inventor: Philip Chatterton, 8165 N. University Dr., #42, Tamarac, Fla. 33321

[21] Appl. No.: 431,211

[22] Filed: Nov. 3, 1989

[51] Int. Cl.[5] ..... F25C 1/00

[52] U.S. Cl. ..... 62/340; 249/108; 249/120; 249/53 R; 249/130; 249/126; 249/141

[58] Field of Search ..... 62/66, 382, 340, 356; 249/120, 121, 126, 127, 129, 53 R, 108, 130, 141; 222/181, 185, 478, 557, 560; 312/350

[56] References Cited

U.S. PATENT DOCUMENTS

| | | | |
|---|---|---|---|
| 2,786,613 | 3/1957 | Morrison | 222/185 X |
| 3,211,334 | 10/1965 | McShea | 222/185 X |
| 3,306,567 | 2/1967 | Frei, Sr. | 249/127 X |
| 3,443,785 | 5/1969 | Ewers | 249/121 X |
| 4,293,075 | 10/1981 | Veralrud | 312/350 X |
| 4,366,941 | 1/1983 | Harris | 249/120 |
| 4,432,529 | 2/1984 | McMillan | 249/121 X |
| 4,601,174 | 7/1986 | Wilson | 62/356 X |
| 4,627,595 | 12/1986 | Rhodes et al. | 249/126 X |
| 4,815,691 | 3/1989 | Cooley | 249/120 |

FOREIGN PATENT DOCUMENTS

| | | | |
|---|---|---|---|
| 20621 | 4/1956 | Fed. Rep. of Germany | 249/127 |

*Primary Examiner*—William E. Tapolcai

*Attorney, Agent, or Firm*—Malloy, Downey & Malloy

[57] ABSTRACT

A water filling assembly for ice trays including a reservoir disposed in water delivering relation to each of a plurality of vertically stacked ice trays within a housing wherein the reservoir and trays are cooperatively structured to successively fill each of said trays from an uppermost one in the stacked array to a lower most one upon the selective passage of liquid from said reservoir to said trays.

14 Claims, 2 Drawing Sheets

FILLING ASSEMBLY FOR ICE TRAYS

BACKGROUND OF THE INVENTION

1. Field of the Invention

This invention relates to an automatic water filling assembly for ice trays which eliminates the necessity for the removal of individual trays from a freezer or like reduced temperature environment for filling.

2. Description of the Prior Art

The use of ice trays to form ice cubes is of course well known and in wide use throughout the world. Typically, individual trays are placed in the freezer portion of a refrigerator once they are filled with water. Sufficient time is allowed to elapse with the result that ice cubes are formed in each of the forming cavities of the trays. Typically, after the ice has been used or removed from a given tray, it is removed from the refrigerator, carried to a spigot, sink or the like, filled and then returned to the refrigerator for freezing. Filling of ice trays is not only a tedious task but is also time consuming when one considers the care that has to be taken to avoid spillage when returning the filled ice tray from the sink to the refrigerator. These are probably some of the factors which account for many of the continually empty ice trays to be found in domestic refrigerators. While advancements in the prior art have, in some cases, eliminated the necessity of filling numerous ice trays, such solutions have generally led to the production and use of automatic, electrically powered ice makers. While functional, such ice makers are generally considered to be expensive and in certain instances plagued with maintenance problems.

Accordingly, there is a need for an automatic ice tray filling mechanism which will overcome the above set forth problems relating to the task of filling such trays and further wherein such a preferred automatic filling assembly can be positioned and maintained intact on the interior of the freezer portion of the refrigerator for prolonged and continued use. Such a mechanism should preferably be inexpensive for purchase by the consumer and effectively be maintenance free and further be capable of having a long operable life under what may be considered harsh operating conditions.

The prior art does include molding or forming containers for ice cubes. Such devices are represented in the following United States Patents.

Daenen, U.S. Pat. No. 4,372,526, discloses an ice cube making apparatus and serving system including a plurality of separate freezing compartments for forming ice cubes and incorporating a liquid drain arrangement so that excess water may be removed from the freezing compartments before the tray is transferred to the freezer.

Bowers, U.S. Pat. No. 1,229,873, discloses a multiple mold which may be filled successively through gravity flow from an uppermost molding chamber to a lower most molding chamber. While gravity flow and the automatic filling of multiple chambers are disclosed, such structure is not directed to the filling of ice trays.

Smith, U.S. Pat. No. 1,971,664, discloses an ice tray having a first and second depth of forming cavities separated by an apertured plate wherein the lower most plurality of forming chambers are filled first by applying a water supply to the uppermost series of chambers.

Price, U.S. Pat. No. 3,565,389, discloses an ice mold in the form of a closed chamber.

While the above set forth structures are representative of at least minimal attempts by the prior art to accomplish filling of ice forming devices in some unique fashion, such devices do not generally overcome the problems as set forth above.

SUMMARY OF THE INVENTION

The present invention is directed towards an automatic filling assembly for ice trays of type to be positioned and maintained within a freezer portion of a refrigerator or like reduced temperature environment and suitable for freezing water. More particularly, the present invention includes a housing including support means formed thereon for the removable supporting of a plurality of ice trays in a vertically stacked array. Each of the ice trays are particularly structured to direct overflow liquid supplied thereto to a next lower and adjacent ice tray in order to enable successive filling of all the plurality of trays in the vertical array.

The housing further includes provision for the support of a reservoir which is preferably an enclosed or at least partially enclosed container like structure. The reservoir further includes an access opening formed therein which allows water or other desired liquid to enter the hollow interior of the reservoir container. The reservoir container is then positioned in supportive relation on the housing above the vertically stacked ice cube trays. A valve structure associated with the reservoir may be activated between a flow-on and a flow-off position. A flow-on position is defined by allowing water flow from the interior of the reservoir container to an upper most one of the ice trays in the vertical stack. The quantity of water delivered from the reservoir will be determinative of the number of trays being filled. Once the upper most tray is filled, any overflow will be directed to the lower trays and accordingly, each of the trays will be filled successively from top to bottom in the vertical stack.

The above set forth structure therefore eliminates the need for individually carrying the trays from the freezer compartment to a filling station such as a sink or the like. Instead, the reservoir is removed from its supportive position on the housing and from the interior of the freezer. The reservoir is then carried to a sink or the like and is filled by passing water through the access opening formed therein Due to the fact that the reservoir has an opening which may be capped, time may be saved by filling the reservoir directly from the spigot when the spigot is opened for "full flow". This of course differs from filling an ice tray when the flow of water from the spigot may be reduced in order to avoid splashing. Further, there is no concern as to the temperature of the water entering the reservoir. Also, the problem of spillage when one carries a filled ice tray from the spigot to the refrigerator or freezer would also be eliminated. Such spillage is common especially among older people, children or those not having a generally steady hand. The spillage problem is effectively eliminated by adding the water directly to the reservoir and placing the cap over the entrance opening thereto. The filled container is then placed in its operative position on an upper most portion of the housing and the valve structure associated therewith is moved to a flow-on position. The plurality of trays are then filled successively as set forth above in an automatic fashion.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
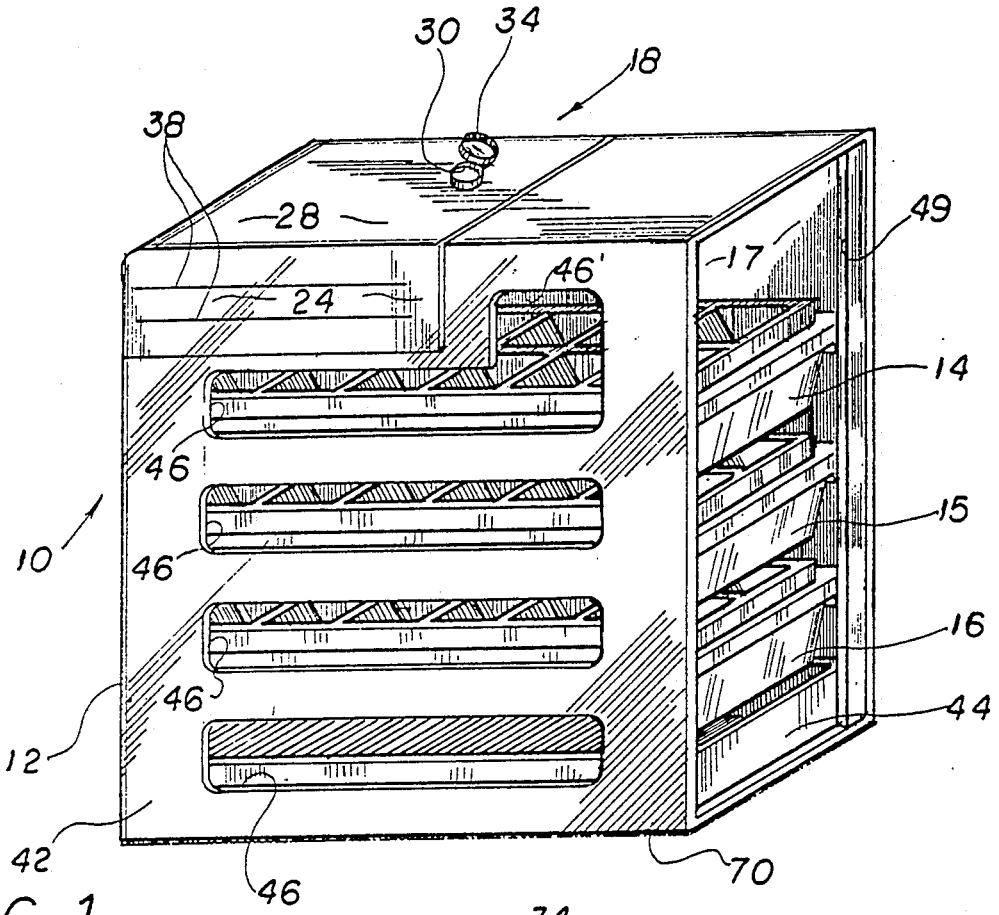
FIG. 1 is a perspective view of a housing portion of the filling assembly of the present invention.
Figure 2:
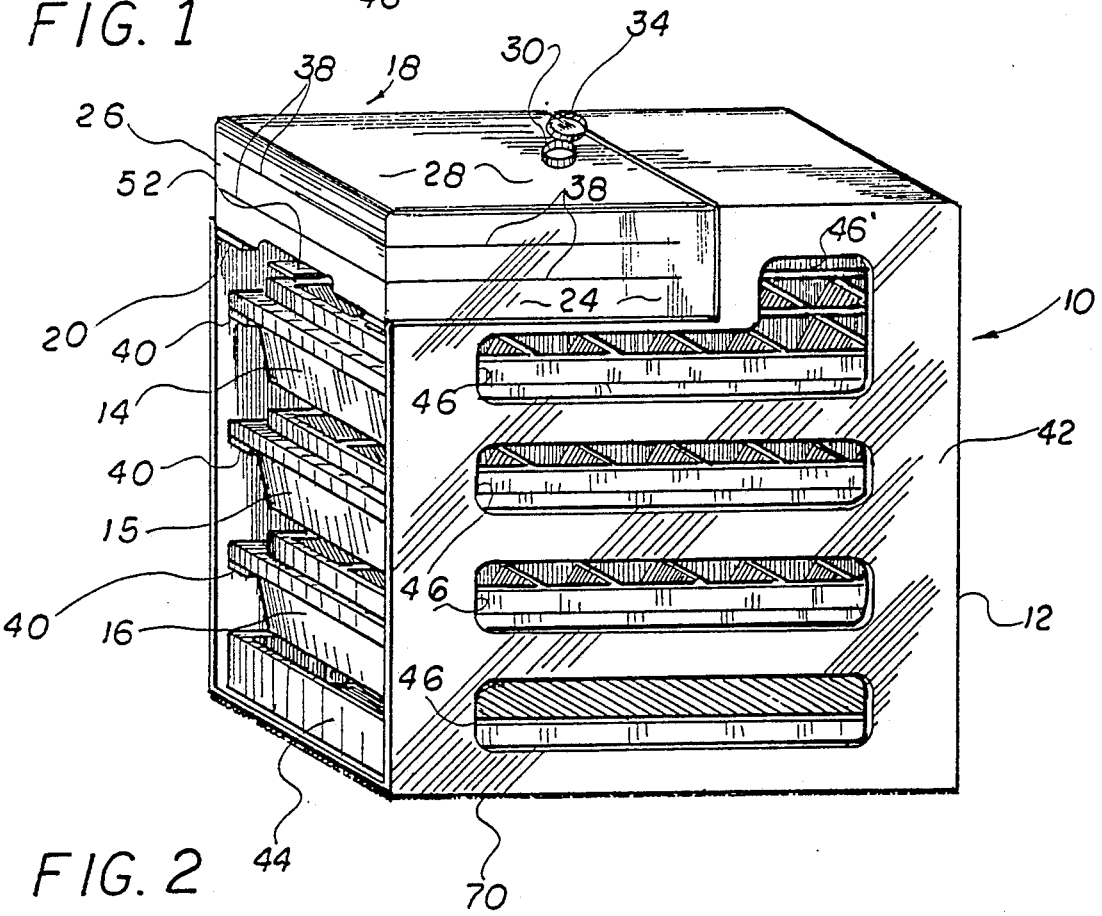
FIG. 2 is a perspective view of the opposite end of the housing portion and filling assembly with the trays assembled therein.
Figure 3:
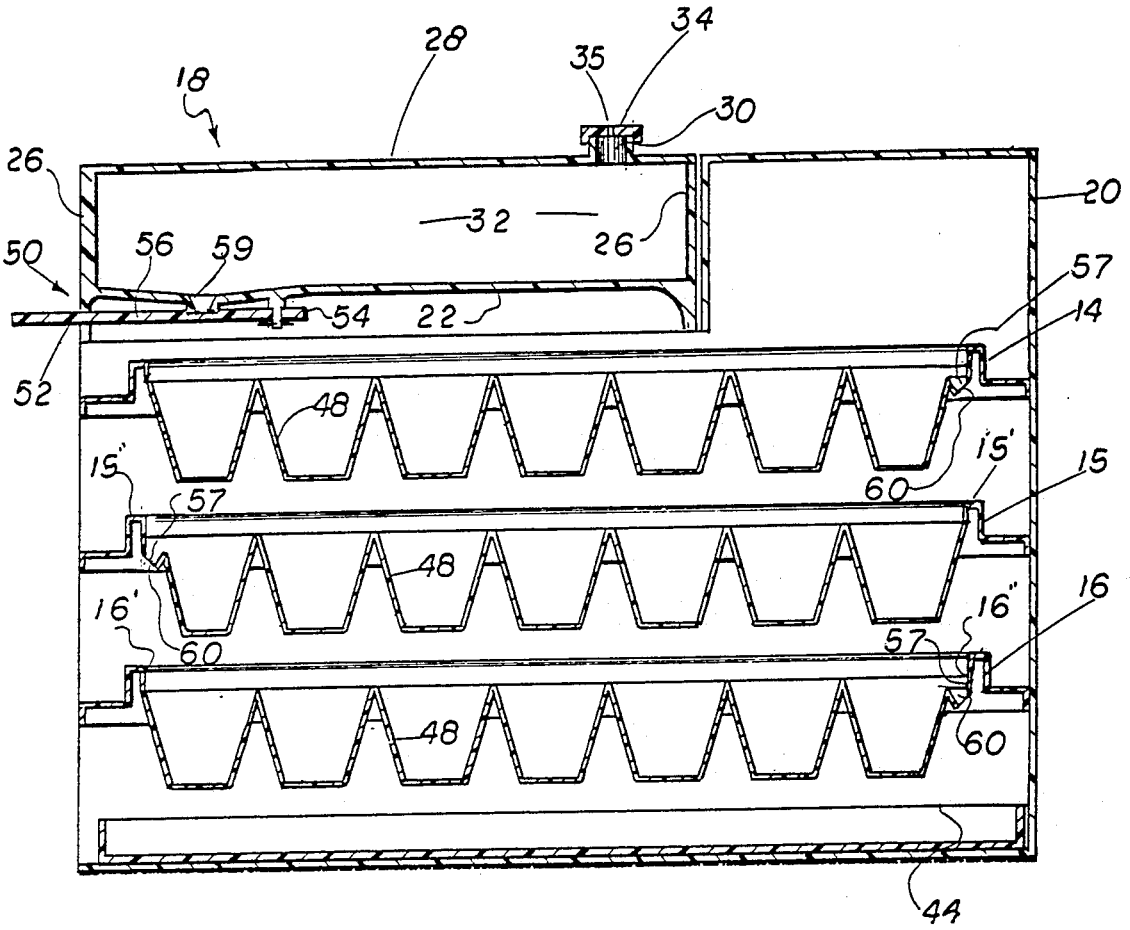
FIG. 3 is a longitudinal, sectional view of the embodiment of FIG. 2.

As shown primarily in FIGS. 1 and 2, the present invention is directed towards a filling assembly for ice forming containers, such as ice trays and generally indicated as 10. The filling assembly, more specifically, comprises a housing 12 having a hollow interior specifically designed to hold a plurality of ice trays 14, 15 and 16 in a spaced apart, substantially vertical array as shown in FIGS. 1, 2 and 3. In addition, a liquid reservoir is generally indicated as 18 and is removably secured to an upper most portion of the housing 12 and is slideable relative to its own longitudinal axis on outwardly extending supporting flanges 20 secured to the inner surface of sidewalls and extending along a distance sufficient to engage at least a majority of an undersurface adjacent the longitudinal sides of the reservoir 18. The reservoir container is shown in FIGS. 1 through 3 and includes a base portion 22, opposite longitudinal side portions 24 being interconnected by oppositely disposed endwalls 26. A cover 28 is secured in covering relation to the interior of the reservoir container 18 and may be attached to each of the upper peripheral edges of the longitudinal sidewalls 24 and endwalls 26 as clearly shown Although not clearly depicted, the cover 28 may be removed from its supported position on the side and end walls of the reservoir for purposes of providing clear access as for cleaning into the interior 32 of the reservoir 18. Cover 28 further includes an access opening as at 30 through which water or other desirable liquid may be entered into the interior of the reservoir as at 32. A lid or cap structure 34 may be hingedly or otherwise attached for covering engagement with the access opening 30 to avoid any chance of spillage of water from the interior. Also, as shown in FIG. 3, a vent opening 35 may be formed in the cap 34 to prevent the build-up of negative pressure within the interior 32 upon emptying the water therefrom through openings 59 and 59', as set forth in greater detail hereinafter. Further, at least one of the endwalls 26 and/or sidewalls 24 may have indicia means formed on the outer surface thereof. Such indicia means is indicative of the amount of water needed within the interior 32 of the reservoir to fill a given number of trays. Such indicia means may include a plurality of spaced apart or graduated lines 38 which may or may not be numbered to correspond to the number of trays within the housing. In any event, the upper level of the water placed within the reservoir should register with the first or second line 38 to fill one or two trays and should be substantially filled to the top or cover 28 to fill all three trays.

Each of the trays 14, 15 and 16 are slideable into and out of the interior 17 of the housing 12 along their own longitudinal axis through the provision of track members 40 mounted on inner surfaces of the sidewalls 42 of the housing 12. Such track members 40 define the mounting means for the various trays in their aforementioned vertically stacked array. Further, an overflow tray as at 44 may be positioned beneath the lower most tray 16 as clearly shown in FIG. 3. Another feature of the housing 12 includes integrally formed circulating openings or apertures 46 formed in the sidewalls 42 and provided to allow the circulation of the reduced temperature air to facilitate freezing of the water within the various forming cavities as at 48 of the trays 14, 15, 16, etc. As shown in FIGS. 1 and 2, the upper most circulating opening may be enlarged as at 46' in order to aid in cooling and air flow through the housing 12. Yet another feature, shown best in FIG. 1, is blocking strips or like structures 49 formed on the rear open end of the housing 12 and in blocking relation to the trays 14, 15 and 16 such that when these trays are positioned on their supporting tracks 40, they will not inadvertently pass through the open rear end, but instead, abuttingly engage the blocking flange 49.

Figure 4:
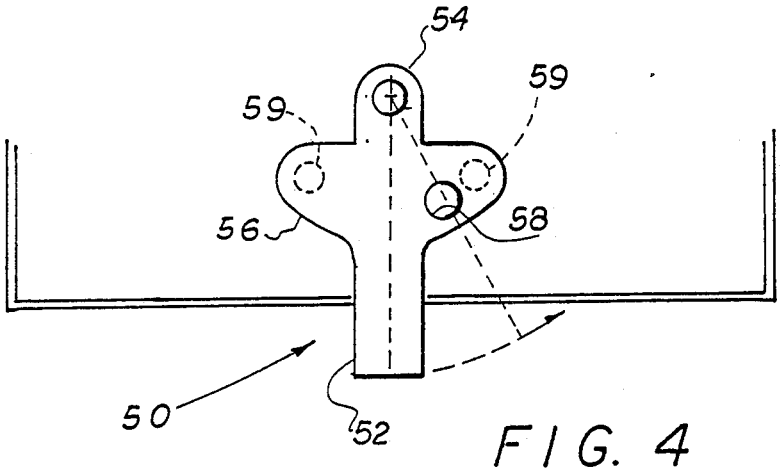
FIG. 4 is a detailed view of a valve structure associated with the present invention.

Each of the trays, as shown in FIG. 3, are disposed so as to receive liquid from the reservoir container 20 by means of a selectively operable valve structure generally indicated as 50 and shown in FIGS. 3 and 4. The valve structure includes an elongated arm 52 having one end as at 54 pivotally attached to under surface or base portion 22 of the reservoir container 18. Manipulation of the elongated arm 52 will cause a flange 56 and a dispensing aperture 58 formed therein to be aligned with a first of two holes 59' formed in the base 22. The flange 56 is configured and dimensioned such that the alignment of aperture 58 with the hole 59' will position the flange 56 out of closing alignment with the spaced apart hole 59 also formed in the base 22 of the reservoir. Therefore, the aligning of aperture 58 in the flange 56 with hole 59' will allow two streams of water to flow out of the holes 59 and 59' into opposite aligned rows of the ice forming cavaties in the trays since flange 56 will no longer be covering the hole 59 and since the aperture 58 will be in alignment with the hole 59'. Water will flow along each of the rows of the forming chambers 48 of the tray 14 successively until the water flow reaches an overflow trough 57 or like structure having an opening 60 formed therein. Water will then flow therefrom into the next lower tray 15 and successively fill the various forming chambers 48 therein from the end 15' to the opposite end 15''. An overflow trough 57 having an opening 60 is located at the far end 15'' and will cause overflow water to flow therefrom to the lower most tray 16 in the same fashion. Forming chambers 48 will be filled successively from one end 16' of tray 16 to the opposite end as at 16''. The overflow trough 57 having an opening 60 is formed in the end 16'' of the tray 16 will allow any surplus water, above that needed to fill all three trays 14, 15, and 16, to flow into the overflow receiving container as at 44. However, accurate "measuring" of the amount of water within the interior 32 of the reservoir container 18 by use of the indicia lines 38 will eliminate any significant overflow passing into the overflow tray 44.

As also evident from a review of FIG. 3, each of the overflow troughs 57 serving to direct overflow liquid from an upper tray as at 14 to a lower tray as at 15 will be located in alternatingly disposed opposite ends of the trays 14, 15 and 16 as shown. In addition, each of the overflow troughs 57 include the trough extending substantially transversely along the end of the tray and the aperture 60 is formed at a low point therein.

Similarly, the base 22 of the reservoir container 18 may also be somewhat slanted such that water will collect at a lower most point at which the exiting apertures 59 are located.

As also shown in FIGS. 1 and 2, a skid resistant material 70 in any of a variety of configurations or structures could be placed on the undersurface of the base of the housing 12 in order to provide a stable placement and support of the housing within a freezer compartment of an ordinary refrigerator.

Yet another feature not specifically shown is the variance in the configuration of the reservoir 18 to possibly include indentations for fingers or hands of the user in order to facilitate carrying or gripping of the reservoir as it is removed from the housing 12, filled and/or replaced on the housing 12.

Now that the invention has been described,

What is claimed is:

1. A water filling assembly designed to fill containers in which ice is formed when placed in a reduced temperature environment, said assembly comprising, in combination, a. a plurality of ice trays each including a plurality of forming cavities extending the length thereof and a liquid exiting structure formed thereon and disposed in communicating relation with a next adjacent tray, b. a housing including a support means structured for support of said plurality of trays in a spaced, vertically aligned and stacked array, c. a reservoir mounted on said housing and including a hollow interior portion disposed in fluid delivering relation to said plurality of trays, d. said reservoir and said plurality of trays removably mounted on the housing and correspondingly disposed to direct liquid flow under gravity from said reservoir successively to each of said trays, e. said reservoir and each of said trays being collectively mounted on said housing in a vertical, completely overlying, stacked and spaced relation to one another, said reservoir and plurality of trays collectively disposed to successively direct liquid flow, under gravity, from said reservoir, to an uppermost one of said plurality of trays and therefrom, successively through each of such plurality of trays to a lowermost one of said plurality of trays, and f. said liquid exiting structure of each of said trays including an overflow trough extending transversely across said tray and disposed at one longitudinal end thereof, said trough including aperture means formed therein for the exiting of liquid overflow therefrom to a next lower adjacent tray mounted within said housing.

2. An assembly as in claim 1, wherein said reservoir includes a cover portion disposed in overlying and covering relation to said hollow interior portion and the liquid contents therein.

3. An assembly as in claim 2, wherein said cover includes an access opening formed therein and communicating with said interior portion and being dimensioned and configured to allow passage of liquid therein.

4. An assembly as in claim 3, further comprising a lid structure removably attached in covering relation to said access opening and including a vent means formed therein and structured for venting said hollow interior portion to atmosphere.

5. An assembly as in claim 1, further comprising valve means formed therein and structured for selective regulating liquid flow from said reservoir to a next adjacent one of said plurality of trays.

6. An assembly as in claim 1, further comprising an overflow container mounted on said housing beneath said lower most tray and in fluid receiving relation to overflow therefrom.

7. An assembly as in claim 1, wherein said plurality of trays are collectively oriented such that said overflow troughs are disposed at alternatingly disposed opposite ends of said trays.

8. A water filling assembly designed to fill containers in which ice is formed when in a reduced temperature environment, said assembly comprising, in combination:

a. a plurality of ice trays each including a plurality of forming cavities along the length thereof and a liquid exiting structure formed thereon and disposed in communicating relation with a next adjacent tray, b. a housing including a support means structured for support of each of said trays in a spaced, vertical completely overlying relation to one another, c. a reservoir mounted on said housing and including a hollow interior portion disposed in fluid delivering relation to said plurality of trays, d. said reservoir and said plurality of trays removably mounted on said housing and correspondingly disposed to direct liquid flow under gravity from said reservoir successively to each of said trays, e. each of said trays being removably mounted on an interior of said housing in a supported position, said housing including support means formed on interior surfaces of oppositely disposed sidewalls thereof, f. said support means comprising a plurality of pairs of flanges formed on said interior surfaces of said oppositely disposed sidewalls, said flanges of each flange pair disposed in substantially co-planar, spaced relation to one another and disposed in supporting engagement with opposite longitudinal sides of one of said plurality of trays.

9. A water filling assembly designed to fill containers in which ice is formed when placed in a reduced temperature environment, said assembly comprising, in combination:

a. a plurality of ice trays each including a plurality of forming cavities extending along the length thereof and a liquid exiting structure formed thereon and disposed in communicating relation with a next adjacent tray, b. a housing including a support means structured for support of each of said trays in a spaced, vertical, completely overlying relation to one another, c. a reservoir mounted on said housing and including a hollow interior portion disposed in fluid delivering relation to said plurality of trays, d. said reservoir and said plurality of trays removably mounted within said housing on said support means and correspondingly disposed to direct liquid flow under gravity from said reservoir successively to each of said trays, and e. said housing including spaced apart sidewalls extending longitudinally of said housing, said sidewalls each including circulating openings formed therein and dimensioned and configured to facilitate circulation of air within the reduced temperature environment freely throughout the interior of said housing.

10. An assembly as in claim 9, wherein said reservoir comprises a closed configuration including a base, longitudinal spaced apart sidewalls, interconnecting endwalls secured to said sidewalls and a cover portion secured to upper peripheral edges of each of said endwalls and sidewalls, said cover portion including an access opening integrally formed therein and said reservoir further including a lid structure removably closed in covering relation to said access opening.

11. An assembly as in claim 10, wherein said reservoir is removably mounted on an uppermost support structure of said housing and selectively removable therefrom for filling and replaceable on said housing once filling is accomplished.

12. An assembly as in claim 11, wherein said housing includes indicia means formed thereon in an observable location and structured for indicating quantity of liquid contents within an interior of said housing.

13. An assembly as in claim 9 wherein said reservoir and said plurality of trays are collectively mounted on said housing in a vertically overlying, stacked and spaced relation to one another; said liquid exiting structure of each of said trays including an overflow trough extending transversely across said tray and disposed at one longitudinal end thereof, said trough including aperture means formed therein for the exiting of liquid overflow therefrom to a next lower adjacent tray mounted within said housing.

14. An assembly as in claim 13 wherein each of said trays are removably mounted on an interior of said housing in a supported position, said housing including support means formed on interior surfaces of oppositely disposed sidewalls of said housing, said support means comprising a plurality of pairs of flanges formed on said interior surfaces of said oppositely disposed sidewalls, said flanges of each flange pair disposed in substantially co-planar, parallel and spaced relation to one another and disposed in supporting engagement with opposite longitudinal sides of one of said plurality of trays.

* * * * *